US006276576B1

(12) United States Patent
Thomas

(10) Patent No.: US 6,276,576 B1
(45) Date of Patent: Aug. 21, 2001

(54) TIE TUCKING APPARATUS

(76) Inventor: James B. Thomas, 299 NW. 10th Ct., Boca Raton, FL (US) 33486

( * ) Notice: Subject to any disclaimer, the term of this patent is extended or adjusted under 35 U.S.C. 154(b) by 0 days.

(21) Appl. No.: 09/567,111

(22) Filed: May 8, 2000

(51) Int. Cl.[7] ..... A47G 25/80
(52) U.S. Cl. ..... 223/111; 223/1
(58) Field of Search ..... 223/87, 83, DIG. 1, 223/111, 1; D6/315; 15/236.08

(56) References Cited

U.S. PATENT DOCUMENTS

| | | | | |
|---|---|---|---|---|
| D. 190,402 | * | 5/1961 | Welch | D80/8 |
| D. 218,496 | * | 8/1970 | Barrington | D80/8 |
| 459,362 | | 9/1891 | Guilbert . | |
| 2,104,625 | | 1/1938 | Sherman | 2/154 |
| 2,557,635 | | 6/1951 | Cregar | 2/157 |
| 4,667,346 | | 5/1987 | Strollo | 2/152 X |
| 4,974,842 | * | 12/1990 | Widman | 273/32 |
| 5,390,370 | | 2/1995 | Koy | 2/153 |

* cited by examiner

*Primary Examiner*—Bibhu Mohanty
(74) *Attorney, Agent, or Firm*—Frank L. Kubler

(57) ABSTRACT

A tie tucking apparatus for engaging an edge of a segment of a neck tie wrapped around a user shirt collar and for guiding the tie underneath the user shirt collar includes a plate of relatively unyielding material having a tie engaging end including a tie edge engaging slot extending into the plate and defining plate tabs separated by the engaging slot, the plate tabs being spaced apart by the engaging slot. The apparatus preferably additionally includes a collar abutment plate edge, and the collar abutment edge preferably is angled relative to the engaging slot so that the plate narrows at the tie engaging end to fit more easily under a collar. The plate preferably is elongate and has a plate longitudinal axis and two opposing plate longitudinal ends. The engaging slot optionally extends into the plate parallel to the plate longitudinal axis. Each plate longitudinal end preferably is a tie engaging end, so that the plate may be gripped by a user from either plate longitudinal end for use. The plate has two opposing plate faces and preferably at least one of the plate faces retains and displays advertising indicia. The tie engaging end preferably includes several substantially parallel tie edge engaging slots, dividing the tie engaging end into at least three plate tabs.

12 Claims, 1 Drawing Sheet

TIE TUCKING APPARATUS

BACKGROUND OF THE INVENTION

1. Field of the Invention

The present invention relates generally to the field of clothing and to equipment for assisting people in dressing themselves, such as shoe horns. More specifically the present invention relates to a tie tucking apparatus for engaging an edge of the segment of a neck tie wrapped around a user shirt collar and for guiding the neck tie segment underneath the shirt collar by manually maneuvering the apparatus while the tie remains engaged. The apparatus includes a plate of relatively unyielding material having a tie engaging end and a collar abutment plate edge and having a tie edge engaging slot extending into the plate and defining plate tabs separated by the engaging slot, the plate tabs being spaced apart by the engaging slot. The collar abutment edge preferably is angled slightly relative to the engaging slot so that the plate narrows at the tie engaging end to fit more readily under the collar.

The plate preferably is elongate and substantially rectangular, the engaging slot extending into the plate parallel to the plate longitudinal axis. The tabs on either side of the engaging slot are of equal size and an abutment plate edge preferably is provided on each side of the plate at the plate engaging end, the abutment plate edges being angled so that the plate tapers toward the plate engaging end. It is further preferred that the plate have a plate engaging end at each longitudinal end of the plate, so that the plate can be gripped from either end for use. The two opposing plate faces are optionally imprinted or painted with advertising indicia. The plate is preferably made of a rigid or resilient material such as a metal, a plastic or cardboard. Any number of engaging slots may be provided in a plate engaging edge.

2. Description of the Prior Art

There have long been neck tie supporting, mounting and shaping devices. These devices generally have been directed to such uses as replacing the knot in a tie so that the tie remains unwrinkled, or to clipping a bow tie to wings of a shirt collar. None of these prior devices has been directed to solving the problem of tucking the neck encircling segment of a tie underneath a shirt collar.

Strollo, U.S. Pat. No. 4,667,346, issued on May 26, 1987, discloses a necktie and necktie retainer for securing a necktie without tying the necktie into a knot. Strollo includes a necktie having front and rear apron segments integrally joined by a connecting neckband segment, and a unitary necktie retainer which releasibly secures the tie in a wearing position. The retainer is an elliptical metal plate folded across its minor axis into an acute angle to define forward and rearward plate flaps and oriented so that the fold is at the top, the flaps having central tie passing openings. A slit is provided along a central segment of the fold. The tie is threaded through the flap tie passing openings and wrapped to suggest, and function in place of, a tie knot.

Guilbert, U.S. Pat. No. 459,362, issued on Sep. 8, 1891, teaches a necktie fastener. Guilbert is a buckle constructed of two elongate and co-planar metal rings positioned side by side and connected by a linking strut. A tie is wrapped through the buckle so that an end of the tie is retained in a gap between the two rings and the tie is threaded through the rings.

Koy, U.S. Pat. No. 5,390,370, issued on Feb. 21, 1995, reveals a knot support for a pre-tied necktie. Koy includes an annular necktie knot supporting structure through which the vertical segments of a tie are fitted, the annular structure having a forward face and terminating at its lower end in a tongue portion with a protuberance and a bracket to receive and secure a zipper slide gripping tab at its lower portion.

Cregar, U.S. Pat. No. 2,557,635, issued on Jun. 19, 1951, discloses a tie shaping frame. The Cregar frame is formed of heavy wire and is fitted between the forward and rearward layers of the depending segment of a necktie and shaped to match the intended peripheral shape of the tie.

Sherman, U.S. Pat. No. 2,104,625, issued on Jan. 4, 1938, teaches a neck bow tie having a shirt collar engaging frame structure mounted behind its fabric tie bow flaps. The engaging frame structure includes two laterally and oppositely opening spring clip elements which releasibly grip opposing shirt collar wings.

It is thus an object of the present invention to provide a tie tucking apparatus which is manually operated to engage an edge of a tie adjacent the user shirt collar and to tuck the tie underneath the collar.

It is another object of the present invention to provide such an apparatus which may be held and operated from either of two apparatus ends, so that the user may grab it quickly and use it without having to stop and reorient it.

It is still another object of the present invention to provide such an apparatus which is compact and light weight, so that it may be carried in a user pocket or in a wallet.

It yet another object of the present invention to provide such an apparatus which is inexpensive to manufacture and which may be used as an advertising or promotional item.

It is finally an object of the present invention to provide such an apparatus which can easily be carried in a wallet and always be at hand when needed.

SUMMARY OF THE INVENTION

The present invention accomplishes the above-stated objectives, as well as others, as may be determined by a fair reading and interpretation of the entire specification.

A tie tucking apparatus is provided for engaging an edge of a segment of a neck tie wrapped around a user shirt collar and for guiding the tie underneath the user shirt collar, the apparatus including a plate of relatively unyielding material having a tie engaging end including a tie edge engaging slot extending into the plate and defining plate tabs separated by the engaging slot, the plate tabs being spaced apart by the engaging slot.

The apparatus preferably additionally includes a collar abutment plate edge, and the collar abutment edge preferably is angled relative to the engaging slot so that the plate narrows at the tie engaging end to fit more easily under a collar. The plate preferably is elongate and has a plate longitudinal axis and two opposing plate longitudinal ends. The engaging slot optionally extends into the plate parallel to the plate longitudinal axis. The plate tabs on either side of the engaging slot optionally are of substantially equal size and shape and the plate optionally has a collar abutment edge on each side of the plate at the tie engaging end. The collar abutment tie edges preferably are angled so that the plate tapers toward the tie engaging end. Each plate longitudinal end preferably is a tie engaging end, so that the plate may be gripped by a user from either plate longitudinal end for use. The plate has two opposing plate faces and preferably at least one of the plate faces retains and displays advertising indicia. The plate preferably is made either of a metal or a plastic. The tie engaging end optionally includes several substantially parallel tie edge engaging slots, dividing the tie engaging end into at least three plate tabs.

A tie tucking apparatus is further provided for engaging an edge of a segment of a neck tie wrapped around a user shirt collar and for guiding the tie underneath the user shirt collar, the apparatus including a solid structure having a tie engaging end having a tie edge engaging slot extending into the structure for engaging an edge of a segment of a tie and pushing the segment of the tie underneath the user shirt collar.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 2:
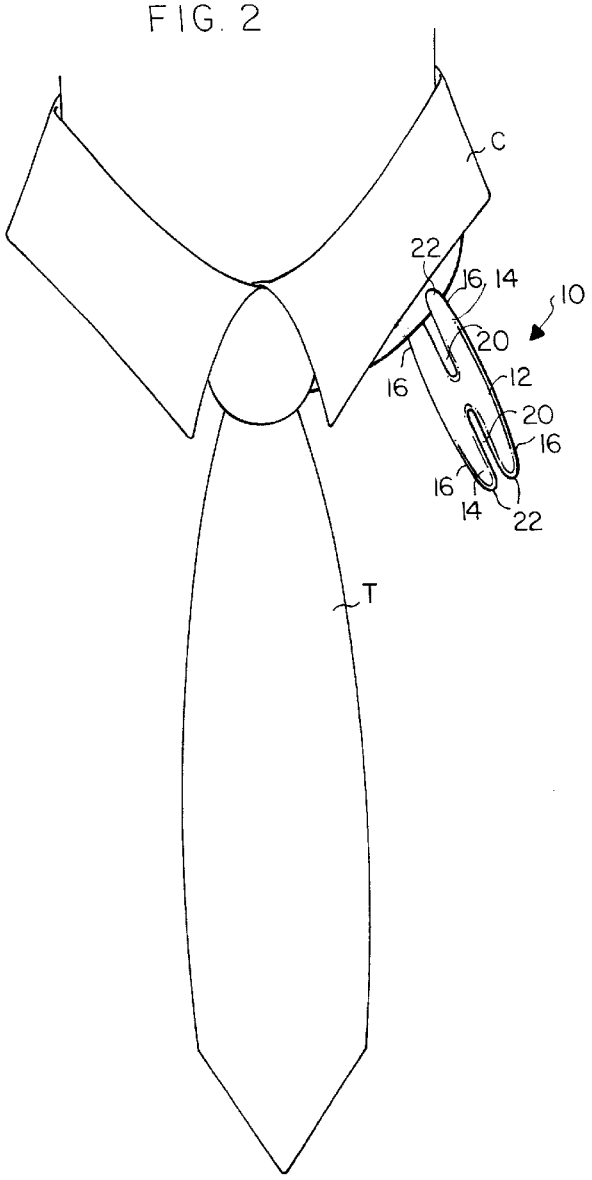
FIG. 2 is a perspective view of the apparatus being used to engage an edge of a neck tie and push the neck tie underneath the user collar.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 1:
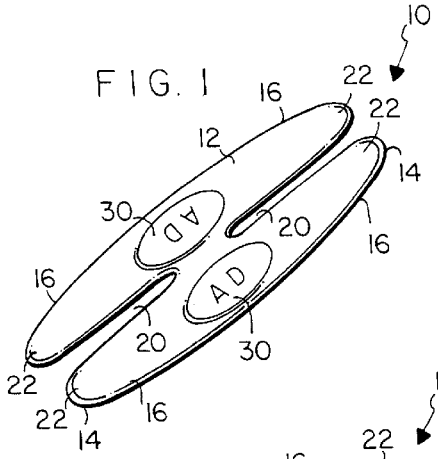
FIG. 1 is a plan view of the preferred embodiment of the tie tucking apparatus, in the form of a plate having a longitudinal shape with a tie engaging end at each longitudinal end, a single tie edge engaging slot at each tie engaging end, and collar abutment plate edges on either side of each tie engaging end which are angled so that the plate narrows at each tie engaging end.

Referring to FIGS. 1–2, a tie tucking apparatus 10 is disclosed for engaging an edge of the segment of a tie T wrapped around a user shirt collar C and for guiding the tie T underneath the user collar C by manually maneuvering apparatus 10. Apparatus 10 includes a plate 12 of relatively unyielding material having a tie engaging end 14 and a collar abutment plate edge 16 and having a tie edge engaging slot 20 extending into the plate 12 and defining plate tabs 22 separated by engaging slot 20, the plate tabs 22 being spaced apart by engaging slot 20. Collar abutment plate edge 16 preferably is angled slightly relative to engaging slot 20 so that the plate 12 narrows at tie engaging end 16 to fit more readily under the collar C.

Figure 4:
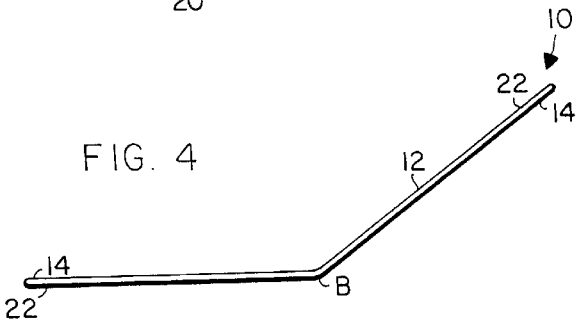
FIG. 4 is an edge view of the apparatus, showing the optional lateral bend across the plate mid-point to make it reach more easily underneath a collar.

Plate 12 preferably is elongate and substantially rectangular, the engaging slot 20 extending into the plate 12 parallel to the plate longitudinal axis L. Tabs 22 on either side of the engaging slot 20 preferably are of equal size and an abutment plate edge 16 is preferably provided on each side of the plate 12 at the tie engaging end 14, the abutment plate edges 14 being angled so that the plate 12 tapers toward the tie engaging end 14. It is further preferred that plate 12 have a tie engaging end 14 at each longitudinal end of the plate 12, so that plate 12 can be gripped for use from either end. The plate 12 optionally has a bend B across its longitudinal mid-section causing the plate 12 to define an obtuse angle, as shown in the edge view of FIG. 4, so that either engaging end 14 can reach more easily underneath a collar when held from the opposing engaging end 14.

The two opposing plate 12 faces are optionally imprinted, painted or otherwise covered with advertising indicia 30. Plate 12 is preferably made of a rigid or resilient material such as a suitable metal alloy, which is optionally a precious metal, a plastic composition or cardboard.

Second Preferred Embodiment

Figure 3:
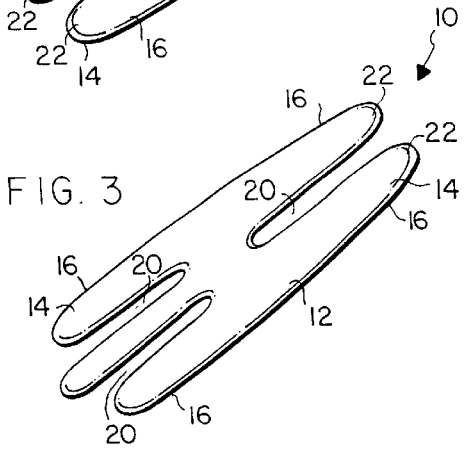
FIG. 3 is a plan view of a second embodiment of the apparatus, having two tie edge engaging slots at one of the tie engaging ends.

A second embodiment of apparatus 10 is provided which is like the first except that two substantially parallel tie edge engaging slots 20 are provided in at least one of the tie engaging ends 14, dividing the given engaging end 14 into three tie tabs 22. See FIG. 3. Should the tie T edge slide out of a first engaging slot 20, it can simply slip into the second engaging slot 20 so that the user can continue tie positioning without interruption. Any number of engaging slots 20 may be provided in a tie engaging end 14.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A tie tucking apparatus, comprising:

a shirt formed of shirt fabric and comprising a wearer neck passing opening at least partially surrounded by a folded over flap of the shirt fabric defining a shirt collar joined to the remainder of said shirt;

a tie having two opposing lateral tie edges and having a tie thickness at said tie lateral edges;

a plate of substantially unyielding material having a tie engaging end comprising a tie edge engaging slot extending into said plate and defining plate tabs separated by said engaging slot, said plate tabs being spaced apart by said engaging slot a distance greater than said tie thickness at said lateral tie edges said plate not mounted to the shirt neck.

2. The apparatus of claim 1, additionally comprising a collar abutment plate edge, wherein said collar abutment edge is angled relative to said engaging slot such that said plate narrows at said tie engaging end to fit more easily under a collar.

3. The apparatus of claim 1, wherein said plate is elongate and has a plate longitudinal axis and two opposing plate longitudinal ends.

4. The apparatus of claim 3, wherein said engaging slot extends into said plate parallel to the plate longitudinal axis.

5. The apparatus of claim 1, wherein said plate tabs on either side of said engaging slot are of substantially equal size and shape and wherein said plate has a collar abutment edge on each side of said plate at said tie engaging end.

6. The apparatus of claim 5, wherein said collar abutment tie edges are angled such that said plate tapers toward said tie engaging end.

7. The apparatus of claim 3, wherein each said plate longitudinal end is a tie engaging end, such that said plate may be gripped by a user from either plate longitudinal end for use.

8. The apparatus of claim 1, wherein said plate has two opposing plate faces and wherein at least one of said plate faces retains and displays advertising indicia.

9. The apparatus of claim 1, wherein said plate is made of one of a metal or a plastic.

10. The apparatus of claim 1, wherein said plate has a lateral bend across its mid-section for enhancing the reach of said engaging end under a collar.

11. The apparatus of claim 1, wherein said tie engaging end comprises a plurality of substantially parallel tie edge engaging slots, dividing said tie engaging end into at least three plate tabs.

12. A tie tucking apparatus, comprising:

a shirt formed of shirt fabric and comprising a wearer neck passing opening at least partially surrounded by a folded over flap of the shirt fabric defining a shirt collar joined to the remainder of said shirt;

a tie having two opposing lateral tie edges and having a tie thickness at said tie lateral edges;

a solid structure not mounted to the shirt neck having a tie engaging end comprising a tie edge engaging slot extending into said structure for engaging an edge of a segment of a tie and pushing the segment of the tie underneath the user shirt collar.

* * * * *